US007710379B2

(12) United States Patent
Iwabuchi et al.

(10) Patent No.: US 7,710,379 B2
(45) Date of Patent: May 4, 2010

(54) DISPLAY DEVICE AND METHOD THEREOF

(75) Inventors: Tomoyuki Iwabuchi, Atsugi (JP); Yasunori Yoshida, Atsugi (JP); Akihiro Kimura, Isehara (JP); Mizuki Sato, Isehara (JP)

(73) Assignee: Semiconductor Energy Laboratory Co., Ltd, Atsugi-shi, Kanagawa-ken ( * ) Notice: Subject to any disclaimer, the term of this patent is extended or adjusted under 35 U.S.C. 154(b) by 743 days.

(21) Appl. No.: 10/928,272

(22) Filed: Aug. 30, 2004

(65) Prior Publication Data

US 2005/0057547 A1 Mar. 17, 2005

(30) Foreign Application Priority Data

Sep. 1, 2003 (JP) ..... 2003-309247

(51) Int. Cl.
*G09G 3/36* (2006.01)

(52) U.S. Cl. ..... 345/98; 345/103

(58) Field of Classification Search ..... 345/103, 345/98, 99, 100

See application file for complete search history.

(56) References Cited

U.S. PATENT DOCUMENTS 6,023,260 A * 2/2000 Higashi ..... 345/100
6,130,657 A * 10/2000 Kurokawa et al. ..... 345/100
6,693,616 B2 2/2004 Koyama et al.
6,788,282 B2 * 9/2004 Ito ..... 345/103
2001/0010512 A1 * 8/2001 Azami ..... 345/100
2003/0011581 A1 1/2003 Tanaka et al.

FOREIGN PATENT DOCUMENTS

JP 2001-306015 11/2001
JP 2003-058133 2/2003

OTHER PUBLICATIONS

Office Action (Application No. 200410074954.3) dated Sep. 7, 2007.

* cited by examiner

*Primary Examiner*—Amr Awad
*Assistant Examiner*—Yong Sim
(74) *Attorney, Agent, or Firm*—Eric J. Robinson; Robinson Intellectual Property Law Office, P.C.

(57) ABSTRACT

A display device and a driving method thereof are provided, which reduces an instantaneous current generated with a charge and discharge of source signal lines and further reduces a load to a power supply line. According to the invention, source signal lines are divided into the first to the n-th groups so as to be charged or discharged according to the first to the n-th latch pulses which are inputted at different timing. Since the number of the source signal lines which start to be charged or discharged at the same time is reduced, an instantaneous current generated with the charge and discharge can be reduced, and a load to the power supply line can be reduced as well.

6 Claims, 6 Drawing Sheets

FIG. 2A
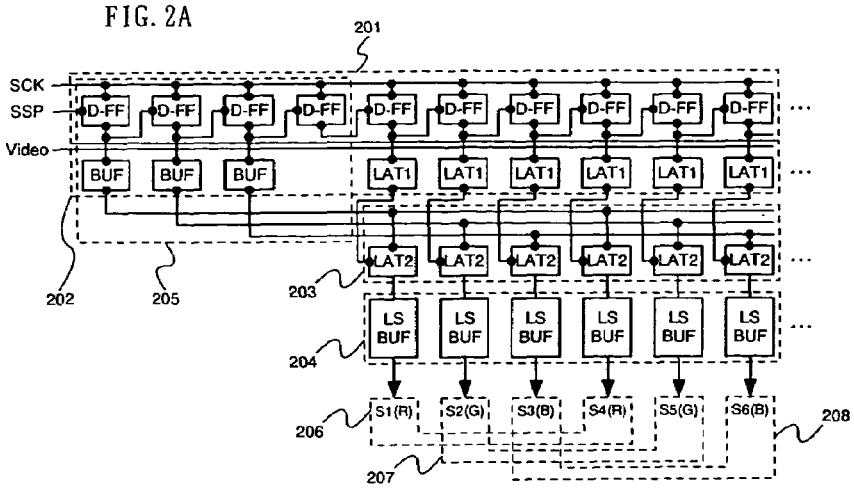
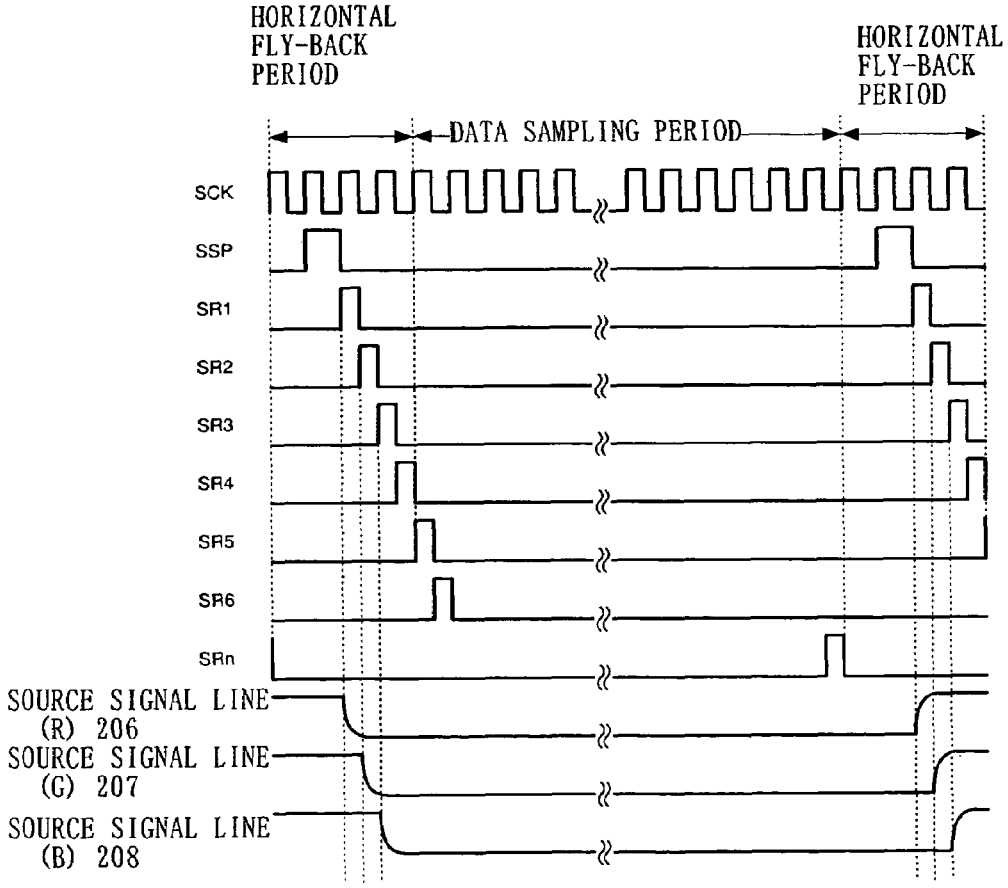
FIG. 2B

FIG. 3A
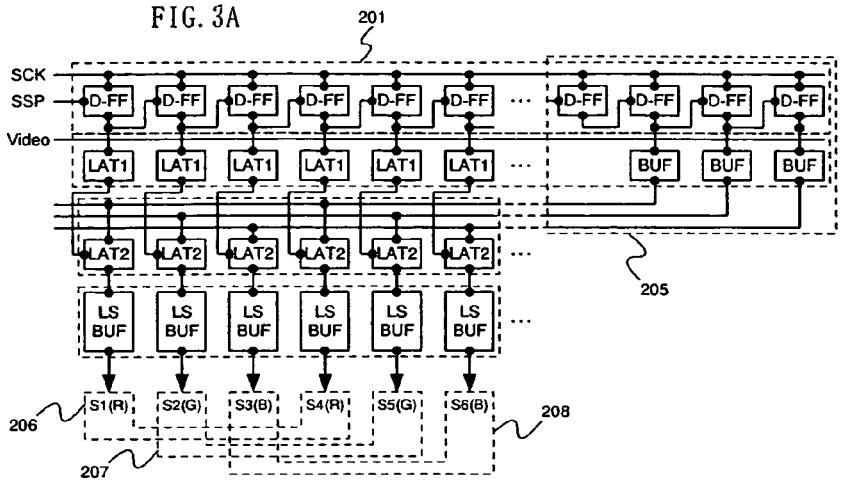
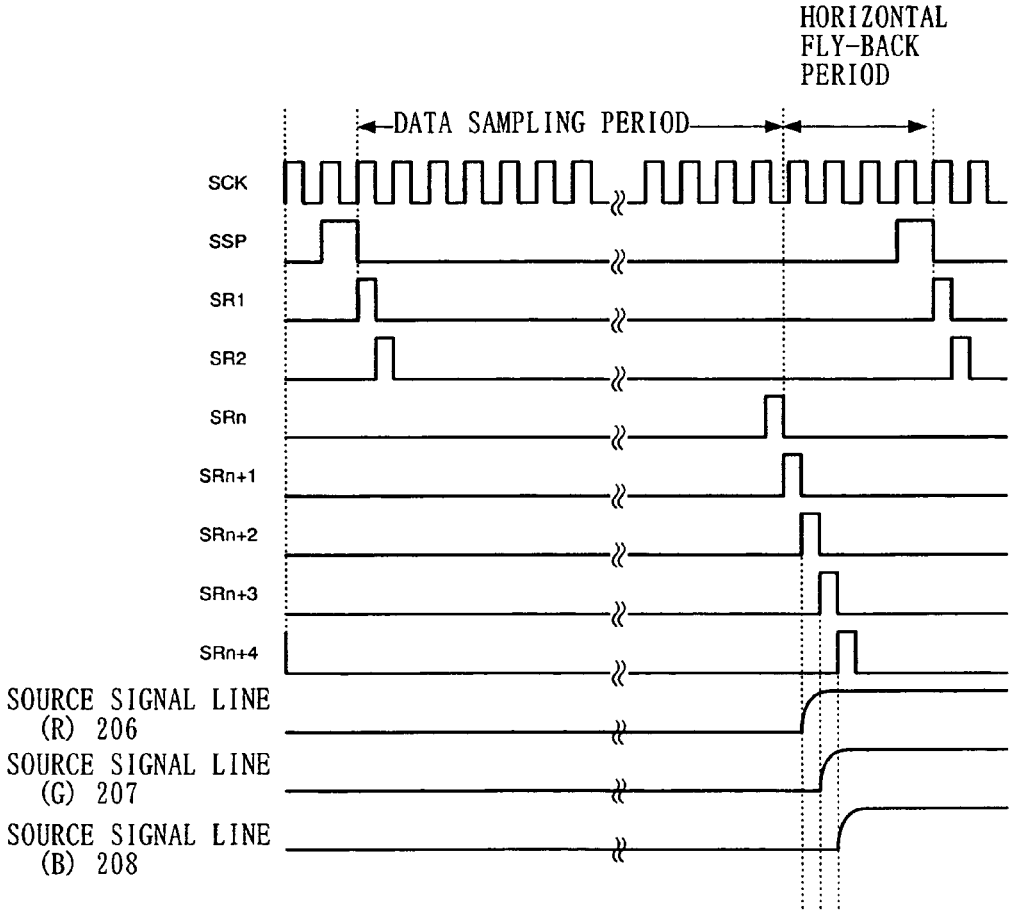
FIG. 3B

FIG. 6A
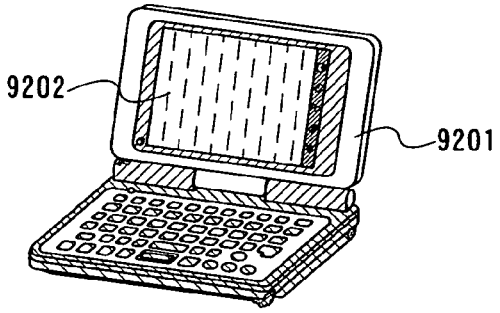
FIG. 6B
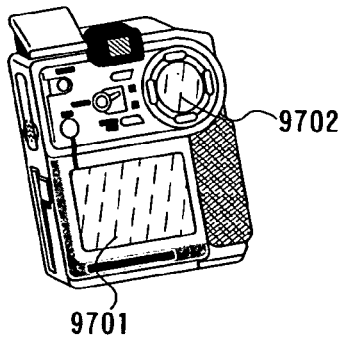
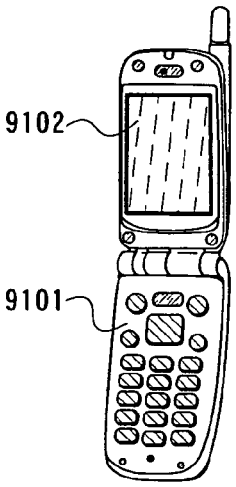
FIG. 6C
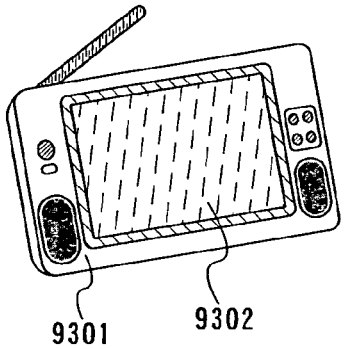
FIG. 6D
FIG. 6E
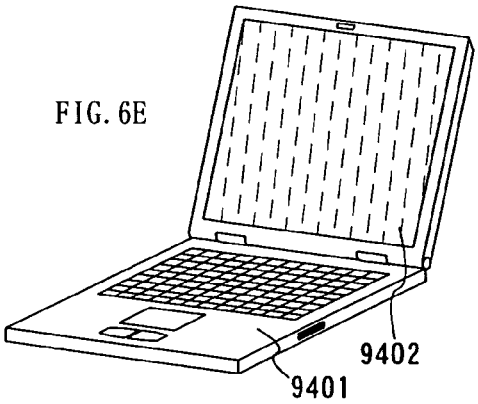
FIG. 6F
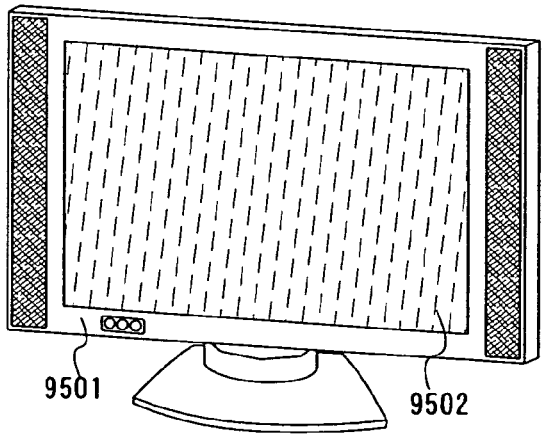

DISPLAY DEVICE AND METHOD THEREOF

BACKGROUND OF THE INVENTION

1. Field of the Invention

The present invention relates to a display device having light emitting elements, and a driving method thereof.

2. Description of the Related Art

In recent years, a flat panel display device which is widely used for a display portion of a portable information terminal as well as a medium-size or a large-size display device is shifting in its driving method from a passive matrix method to the main stream of an active matrix method in which writing of video signals to pixels are carried out rapidly, in accordance with the increase in the number of pixels with the higher resolution.

According to the active matrix method, there are a dot sequential drive in which pixels are sequentially driven on a dot-by-dot basis and a line sequential drive in which pixels are driven on a line-by-line basis. Circuit configurations of the both are shown in FIGS. 5A and 5B.

FIG. 5A shows an example of a circuit configuration of an active matrix type display device using a dot sequential drive. Around a pixel portion 501, a source signal line driver circuit 502 including a shift register 504, a sampling switch 505 and a level shifting buffer 506, and a gate signal line driver circuit 503 including a shift register 507 and a level shifting buffer 508 are disposed.

The shift register 507 outputs a row selection pulse in accordance with a clock pulse (GCK) and a start pulse (GSP) from the first stage in sequence. The outputted pulse undergoes an amplitude modulation and the like in the level shifting buffer 508, whereby gate signal lines are selected from the first row in sequence.

In the rows where gate signal lines are selected, the shift register 504 outputs a sampling pulse in accordance with a clock signal (SCK) and a start pulse (SSP) from the first stage in sequence. The sampling switch 505 samples a video signal (Video) in accordance with a timing at which the sampling pulse is inputted, and charges or discharges source signal lines.

The above operation is performed from the first row to the last row in sequence, thus writing for one frame is completed. A similar operation is repeated thereafter to display images.

FIG. 5B shows an example of a circuit configuration of an active matrix display device using a line sequential drive. Around a pixel portion 511, a source signal line driver circuit 512 including a shift register 514, a first latch circuit 515, a second latch circuit 516 and a level shifting buffer 517, and a gate signal line driver circuit 513 including a shift register 518 and a level shifting buffer 519 are disposed.

The shift register 518 outputs a row selection pulse in accordance with a clock pulse (GCK) and a start pulse (GSP) from the first stage in sequence. The outputted pulse undergoes an amplitude modulation and the like in the level shifting buffer 519, whereby gate signal lines are selected from the first row in sequence.

In the rows where gate signal lines are selected, the shift register 514 outputs a sampling pulse in accordance with a clock signal (SCK) and a start pulse (SSP) from the first stage in sequence. The first latch circuit 515 samples a video signal in accordance with a timing at which the sampling pulse is inputted, and the video signal that is sampled on each stage is held in the first latch circuit 515.

After video signals for one row are sampled and a latch pulse (LAT) is inputted, the video signals held in the first latch circuit 515 are transferred to the second latch circuit 516 all at once, whereby all the source signal lines are charged or discharged at a time.

The above operation is performed from the first row to the last row in sequence, thus writing for one frame is completed. A similar operation is repeated thereafter to display images.

According to the dot sequential drive shown in FIG. 5A, circuit configuration is relatively simple, which leads to small-scale driver circuits while it takes a long time to charge and discharge one source signal line. On the other hand, according to the line sequential drive shown in FIG. 5B, circuit configuration is relatively complex, which leads to large-scale driver circuits. However, as the charge and discharge for all the source signal lines are performed in parallel, writing can be performed with a sufficient time.

SUMMARY OF THE INVENTION

A source signal line is a load to a buffer due to a plurality of TFTs provided in the pixel portion and parasitic capacitance. In the line sequential drive, all the source lines are charged or discharged at a time when a latch signal (LAT) is inputted, therefore, a large instantaneous current flows through the buffer. When a current supply capacity of a power supply line is not high enough for the instantaneous current, a circuit may malfunction due to a voltage drop of the power supply line itself. In addition, since a large current supply capacity is required for an external circuit as well, it involves quite a large load.

In particular, while the display device used for a portable information terminal is required to have a higher resolution in order to enhance image quality, compactness and low consumption are regarded as vital, which makes the above problem unavoidable. That is, a method for extending a width of a wiring in order to give enough capacity to a power supply line, or a method for adopting a high-capacity power supply IC for an external circuit is not a realistic solution to the above problem since it requires a size enlargement of a driver circuit and increase in cost.

In view of the foregoing problems, the invention provides a display device and a driving method thereof which can provide enough time for source signal lines to be charged or discharged and a reduction of a load to a power supply line and external circuits, which are the advantages of the line sequential drive.

In order to solve the foregoing problems, the invention takes the following measures.

As set forth above, in the line sequential drive, source signal lines are charged or discharged all at once after the input of a latch pulse (LAT). Therefore, a large current flows in the early stages of the charge or the discharge period, and the amount of current is decreased with the change in potential of the source signal lines. Thus, the current flow stops at the completion of the charge and discharge.

Hereupon, the source signal lines are divided into a plurality of groups. By inputting a latch pulse to each of the groups at different timing, the start timing of charge and discharge for each source signal line becomes different. Accordingly, the number of the source signal lines which start to be charged or discharged at the same time is reduced, which reduces a load to the power supply line. Although the start timing of the charge and discharge is made different in each line, the total amount of current remains the same as a result while the influence such as a voltage drop in the power supply line is mitigated. Thus, all the source signal lines can be charged or discharged normally as a whole.

The structure of the invention is described below.

According to the invention, a display device and a driving method thereof are provided, which can provide enough time for source signal lines to be charged or discharged and a reduction of a load to a power supply line and external circuits, which are the advantages of the line sequential drive.

BRIEF DESCRIPTION OF THE DRAWINGS

FIGS. 2A and 2B are diagrams showing an embodiment mode of the invention.

FIGS. 3A and 3B are diagrams showing an embodiment mode of the invention.

FIGS. 6A to 6F are views showing examples of electronic apparatuses to which the invention is applied.

BEST MODE FOR CARRYING OUT THE INVENTION

Embodiment Mode 1

Figure 1A:
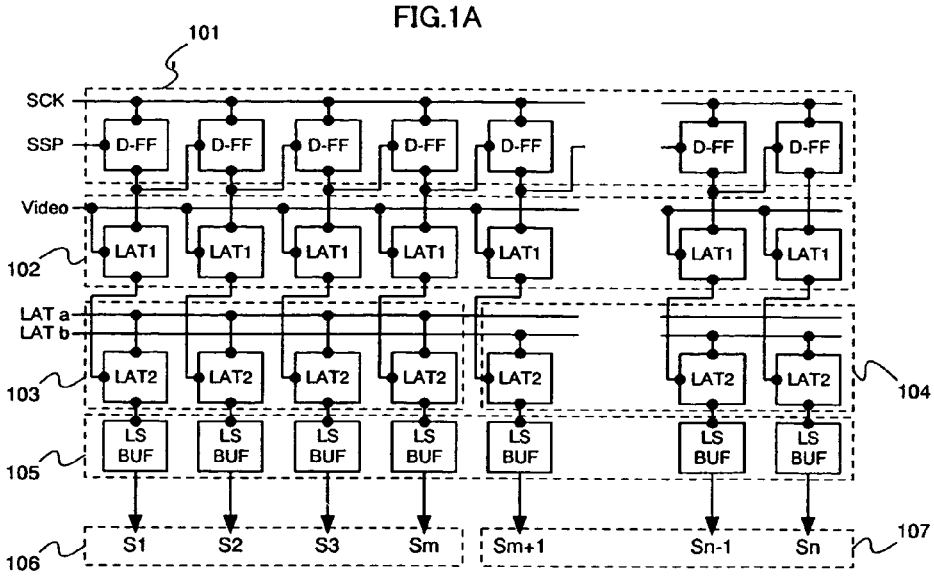
FIGS. 1A and 1B are diagrams showing an embodiment mode of the invention.
Figure 5A:
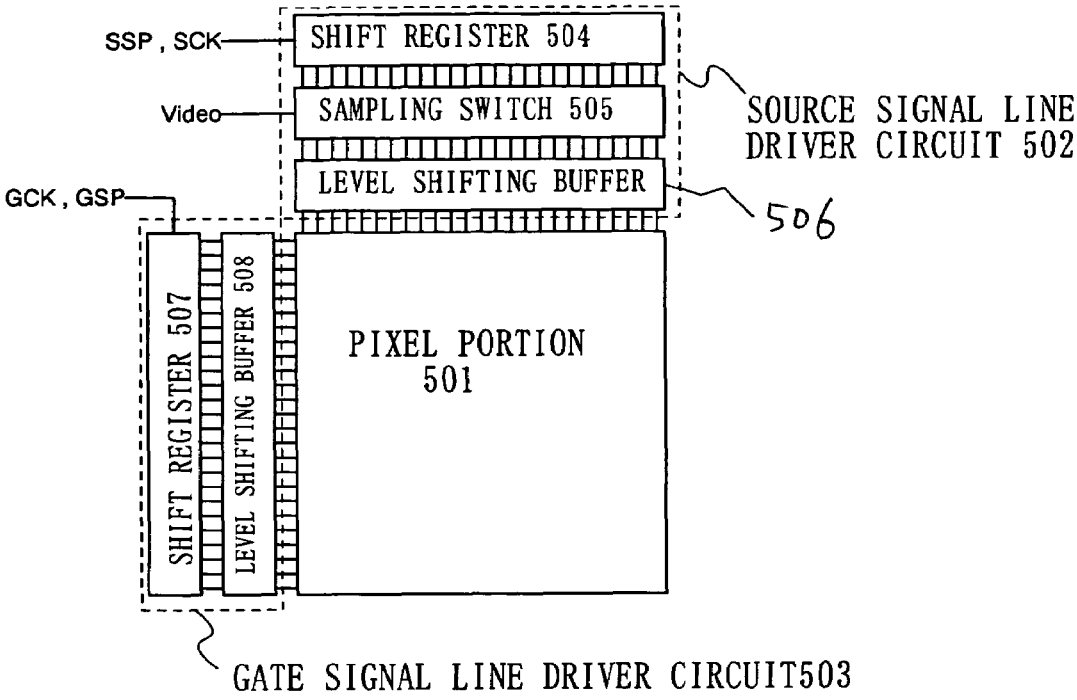
FIGS. 5A and 5B are configuration diagrams of a display device using a dot sequential drive and a line sequential drive respectively.
Figure 5B:
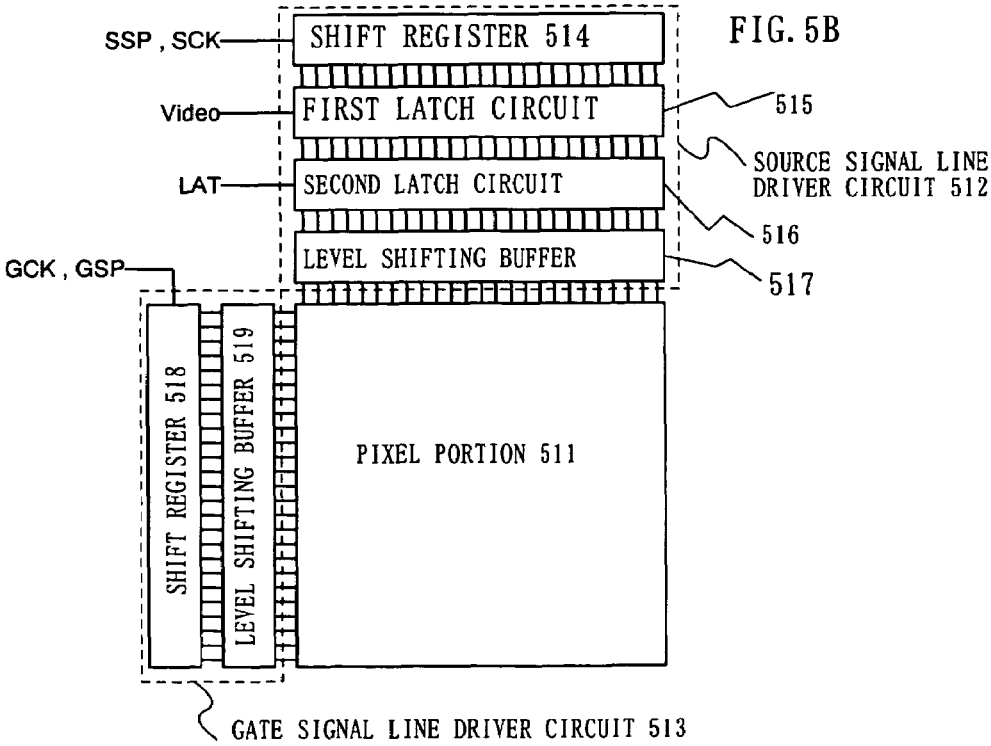

FIG. 1A is a block diagram of a source signal line driver circuit using a line sequential drive which is used in the display device of the invention. As in the conventional driver circuit using a line sequential drive shown in FIG. 5B, the source signal line driver circuit in FIG. 1A includes a shift register 101, a first latch circuit 102, second latch circuits 103 and 104, and a level shifting buffer 105. The second latch circuit is divided into a plurality of groups. In FIG. 1A, it is divided into two groups: the second latch circuit (first group) 104 and the second latch circuit (second group) 105.

Figure 1B:
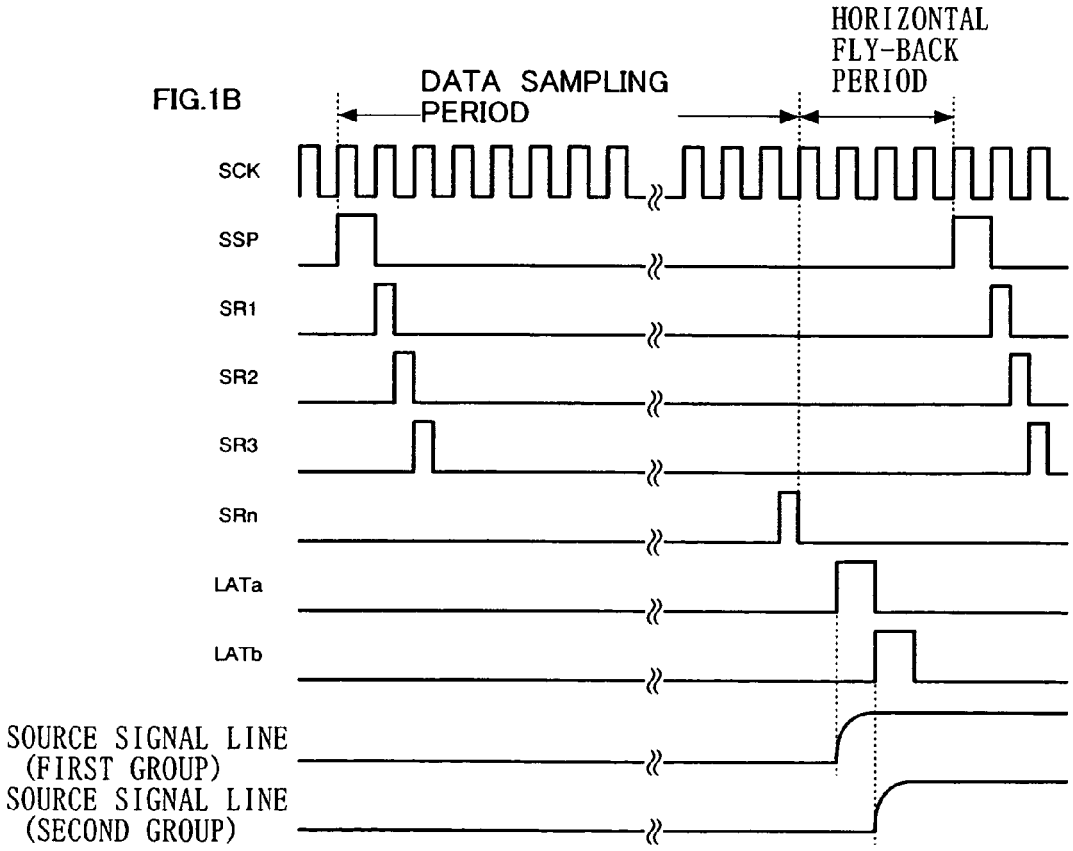

The operation thereof is described now with reference to FIG. 1B. The shift register 101 outputs sampling pulses (SR1, SR2, SR3, . . . and SRn) from the first stage to the last stage in sequence in accordance with a clock pulse (SCK) and a start pulse (SSP). The first latch circuit 102 samples a video signal (Video) from the stage to which the sampling pulse is outputted in sequence. The video signal sampled here is held in the first latch circuit 102 until a latch pulse (LAT) is inputted.

In a data sampling period, when video signals from the first stage to the last stage (n-th stage), namely for one row are sampled, a latch pulse is inputted in a fly-back period. At this time, two kinds of latch pulses, LATa and LATb are inputted at different timing.

In accordance with the input of the latch pulse (LATa), the video signal is transferred to the second latch circuits (first group) 104, and source signal lines (first group) 106 start to be charged or discharged. Subsequently, in accordance with the input of the latch pulse (LATb), the video signal is transferred to the second latch circuits (second group) 105, thus source signal lines (second group) 107 start to be charged or discharged.

The above operation is performed from the first row to the last row in sequence, thus writing for one frame is completed. A similar operation is repeated thereafter to display images. Seeing the timing of the charge or discharge of the source signal lines (first group) 106 and the source signal lines (second group) 107, the rising edge of each potential differs from each other according to the input timing of the latch pulse (LATa or LATb). Accordingly, an instantaneous current generated due to the charge or discharge of the source signal lines can be suppressed to around a half of the conventional one.

When the input timing of the latch pulses is different, time required to charge or discharge all the source lines becomes long in some measure. However, in the line sequential drive, the source signal lines may be charged or discharged between the period in which the latch pulses (LATa and LATb) are inputted once and the period in which the next latch pulses (LATa and LATb) are inputted, which will set off the above problem.

In this embodiment mode, the charge and discharge of the source signal lines are performed by dividing the source signal lines into two groups, however, they may be divided into three, four, or more groups. For example, in a display device capable of displaying a color image, the charge and discharge timing of source signal lines can be performed by dividing the source signal lines into R, G and B groups.

Embodiment Mode 2

FIG. 2A is a block diagram of a source signal line driver circuit using a line sequential drive which is used in the display device of the invention, which has a different configuration from that in Embodiment Mode 1. As a primary configuration, the source signal line driver circuit includes a shift register 201, a first latch circuit 202, a second latch circuit 203, and a level shifting buffer 204 as in the conventional circuit and Embodiment Mode 1. In this embodiment mode, the second latch circuit 203 is divided into three groups of R, G and B. A latch pulse for controlling the operation of the second latch circuit 203 and controlling the charge and discharge timing of the source signal lines is generated internally in dummy stages shown by a dotted frame 205 in FIG. 2A by using a clock signal (SCK) and a start pulse (SSP).

The operation thereof is described now with reference to FIG. 2B. In accordance with the clock signal (SCK) and the start pulse (SSP), the shift register 201 outputs sampling pulses (SR1, SR2, SR3, . . . and SRn) from the first stage to the last stage (n-th stage) in sequence. In FIG. 2A, the first stage to the fourth stage of the shift register 201 are the dummy stages. Thus, the sampling pulses which are actually used for sampling video signals correspond to the outputs of the fifth stage to the last stage of the shift register 201.

In a data latch sampling period, the first latch circuit 202 samples and stores a video signal from the first stage in sequence. After the completion of the sampling of the video signal on the last stage, the shift register 201 starts to output a sampling pulse once again in accordance with the clock signal (SCK) and the start pulse (SSP). Here, among the sampling pulses outputted from the dummy stages, those from the first stage to the third stage are used as latch pulses so as to drive the second latch circuit 203.

In the second latch circuit 203, when the latch pulse using the sampling pulse (SR1) from the first stage is inputted, source signal lines which belong to the R group start to be charged or discharged. Then, when the latch pulse using the sampling pulse (SR2) from the second stage is inputted, source signal lines which belong to the G group start to be charged or discharged. Further, when the latch pulse using the sampling pulse (SR3) from the third stage is inputted, source signal lines which belong to the B group start to be charged or discharged.

The subsequent operation from the sampling of the video signals to the charge and discharge of the source signal lines are performed to the last row in sequence, thus writing for one frame is completed. A similar operation is repeated thereafter to display images.

According to the configuration of this embodiment mode, the latch pulse is not required to be inputted externally, and operation from the sampling of the video signals to the charge and discharge of the source signal lines are performed automatically in synchronism with the operation of the shift register, which contributes to the reduction in the number of input pins to a panel. Such reduction in the number of input pins is quite effective for reducing a panel size of a display device used for a portable information terminal, in particular.

Here, the dummy stages are provided in the forward ends of the shift register and sampling pulses from the first stage to the third stages are utilized as a means for generating a latch pulse internally. However, as shown in FIG. 3A, the dummy stages may be provided in the tail ends of the shift register and a sampling pulse around the last stage may be used as a latch pulse as well. In this case, the first stage to the n-th stages are used for sampling video signals, and the (n+1)-th stage to the (n+4)-th stage are used as dummy stages. Sampling pulses from the (n+2)-th stage to the (n+4)-th stage are utilized as latch pulses for controlling the charge and discharge timing of the source signal lines for R, G and B. According to the invention, a means for generating a latch pulse internally is not limited to the above.

Embodiment 1

The invention is applied to a display device fabricated for the use of a portable information terminal, in which organic electroluminescence (EL) elements are arranged in a light emitting portion, whereby a current consumption thereof is compared to that of a display device using a conventional method. The result is shown in FIGS. 4A and 4B.

A display device used for the experiment has a pixel density of 240×3 (RGB) columns×320 rows, and source signal lines thereof are charged or discharged using a line sequential drive. According to the conventional method, 720 source signal lines are charged or discharged at the same time. On the other hand, according to the display device to which the invention is applied, 240 source signal lines are charged or discharged at the same time.

Figure 4A:
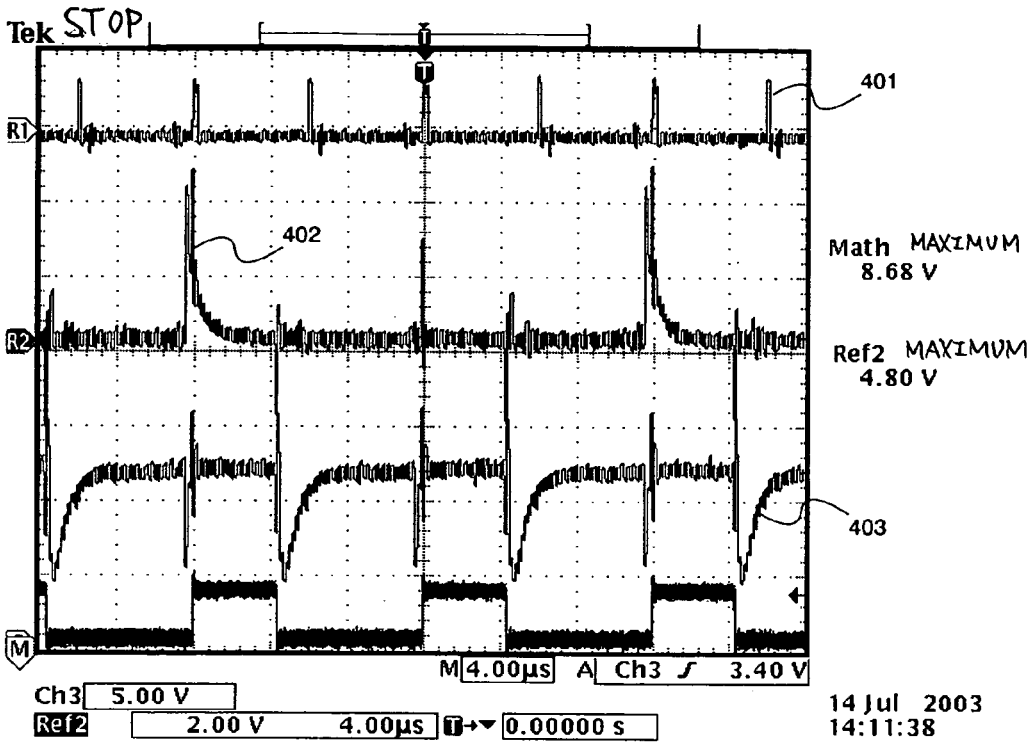
FIGS. 4A and 4B are diagrams showing the measurement result on an instantaneous current of a display device using a conventional method and the display device of the invention respectively.
Figure 4B:
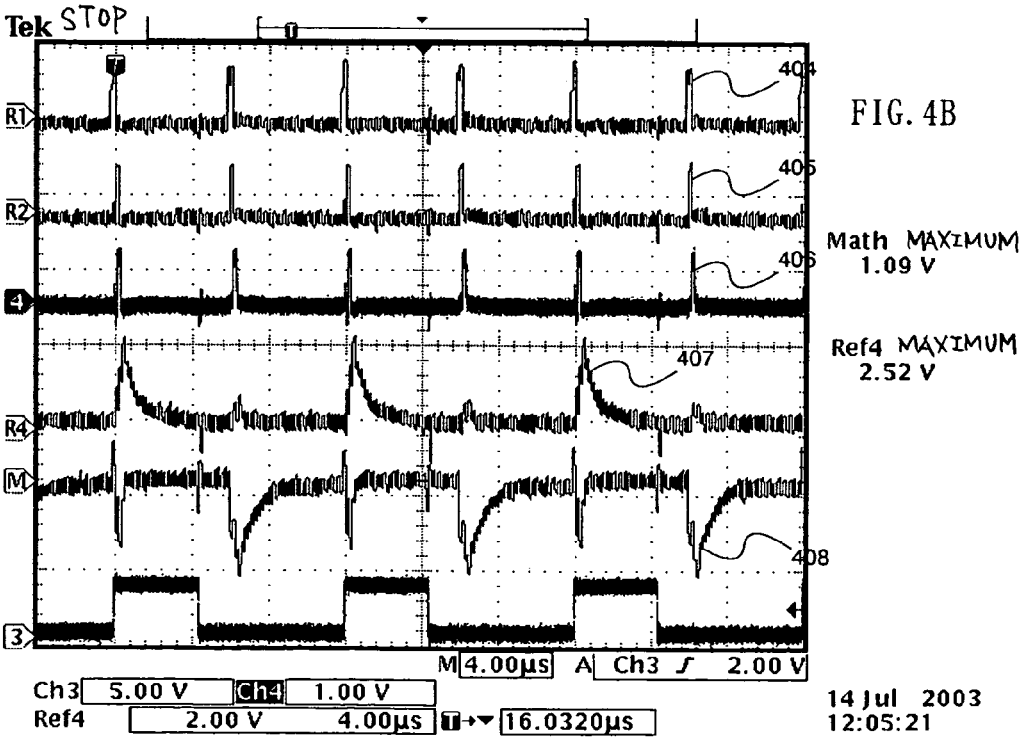

FIG. 4A shows a screen of an oscilloscope which shows a potential change of each of a latch pulse inputted to the panel, and positive and negative power supplies connected to the last buffer portion which charges or discharges source signal lines. In FIG. 4A, reference numeral 401 denotes a potential change of a latch pulse, 402 denotes a potential change of a negative power supply, and 403 denotes a potential change of a positive power supply. The potential change of a power supply line is measured by connecting a resistor having a resistance of 100 Ω to the power supply line in series, and measuring the potential change in that portion. According to an input of a latch pulse, source signal lines are charged or discharged. Here, the experiment is carried out by alternately writing a High level signal to all the source signal lines as video signals (charge) and writing a Low signal to all the source signal lines (discharge) per line period. It can be seen that the potentials at the negative power supply and the positive power supply change alternately at substantially the same timing as the input of a latch pulse.

According to the waveform 402 in FIG. 4A, a largest instantaneous voltage drop in the resistor portion which is connected to the negative power supply (the potential draws closer to 0 V due to the voltage drop, namely it is on the rise as it is a negative power supply) is 3.6 V. That is, the largest instantaneous current is 3.6 V/100 Ω=36 mA.

Similarly, according to the waveform 403 in FIG. 4A, the largest instantaneous voltage drop in the resistor portion which is connected to the positive power supply is 2.8 V. That is, the largest instantaneous current is 2.8 V/100 Ω=28 mA.

FIG. 4B shows a similar screen of an oscilloscope in the case of applying the invention. The display device of this embodiment mode has the configuration shown in Embodiment Mode 2 (FIG. 3). Reference numerals 404, 405 and 406 each denotes a potential change of a latch pulse for controlling the timing at which source signal lines for R, G and B are charged or discharged, 407 denotes a potential change of the negative power supply, and 408 denotes a potential change of the positive power supply. The conventional measuring method is employed here as the above.

According to the waveform 407 in FIG. 4B, the largest instantaneous voltage drop in the resistor portion which is connected to the negative power supply is 2.0 V. That is, the instantaneous largest current is 2.0 V/100 Ω=20 mA.

Similarly, according to the waveform 408 in FIG. 4B, a largest instantaneous voltage drop in the resistor portion which is connected to the positive power supply is 2.4 V. That is, the largest instantaneous current is 2.4 V/100 Ω=24 mA.

When comparing the instantaneous largest current between the conventional method and the case of applying the invention, the largest instantaneous current at the negative power supply is decreased by 44% while the largest instantaneous current at the positive power supply is decreased by 29%, which proves the advantageous effect of the invention. The instantaneous current is ideally in proportion to the divided number of source lines to be charged or discharged. According to the timing of this embodiment mode, an input timing of each latch pulse is close to each other: at the moment the source signal lines for G start to be charged or discharged, the source lines for R are not yet charged or discharged completely, and at the moment at which the source signal lines for B start to be charged or discharged, the source signal lines for G are not yet charged or discharged completely. Thus, the number of the source signal lines to be charged or discharged is large in the overlapped period. The instantaneous current is preferably small. Therefore, it is preferable that the charge and discharge timing of each source signal line is set so as to be as far from each other as possible.

Embodiment 2

Electronic apparatuses using a display device having a pixel region in which light emitting elements are arranged include a television set (TV, TV receiver), a digital camera, a digital video camera, a mobile telephone set (mobile phone), a portable information terminal such as a PDA, a portable game machine, a monitor, a computer, a sound reproducing device such as a car audio set, an image reproducing device provided with a recording medium, such as a home game machine, and the like. Specific examples of these electronic apparatuses are described with reference to FIGS. 6A to 6F.

FIG. 6A shows a portable phone using the display device of the invention, which includes a main body 9201, a display portion 9202, and the like. According to the invention, charge and discharge time of source signal lines and a load to an external circuit can be reduced.

FIG. 6B shows a digital video camera using the display device of the invention, which includes display portions 9701 and 9702, and the like. According to the invention, charge and discharge time of source signal lines and a load to an external circuit can be reduced.

FIG. 6C shows a portable terminal using the display device of the invention, which includes a main body 9101, a display portion 9102, and the like. According to the invention, charge and discharge time of source signal lines and a load to an external circuit can be reduced.

FIG. 6D shows a portable television set using the display device of the invention, which includes a main body 9301, a display portion 9302, and the like. According to the invention, charge and discharge time of source signal lines and a load to an external circuit can be reduced.

FIG. 6E shows a portable personal computer using the display device of the invention, which includes a main body 9401, a display portion 9402, and the like. According to the invention, charge and discharge time of source signal lines and a load to an external circuit can be reduced.

FIG. 6F shows a television set using the display device of the invention, which includes a main body 9501, a display portion 9502, and the like. According to the invention, charge and discharge time of source signal lines and a load to an external circuit can be reduced.

What is claimed is:

1. A display device which performs a line sequential drive comprising:

source signal lines divided into first to n-th (n is an integer of 2 or more) groups to which a control signal for each pixel is outputted;

a shift register for outputting a sampling pulse according to a clock signal and a start pulse in sequence, having dummy stages;

a first latch circuit for sampling and holding a video signal according to the sampling pulse; and second latch circuits divided into first to n-th (n is an integer of 2 or more) groups; and first to n-th (n is an integer of 2 or more) signal paths for inputting first to n-th latch pulses to the first to n-th groups of the second latch circuits based on the held video signal at different timing, respectively for controlling a charge and discharge timing of the first to n-th groups into which the source signal lines are divided based on the held video signal according to the first to n-th latch pulses, respectively, wherein a first n source signal lines each belonging to corresponding one of the first to n-th groups into which the source signal lines are divided are arranged and a second n source signal lines each belonging to corresponding one of the first to n-th groups into which the source signal lines are divided are arranged next to the first n source signal lines, wherein the charge or discharge timing of the first to n-th groups into which the source signal lines are divided is set so that one of the first to n-th groups of the source signal lines is charged or discharged after the others of the first to n-th groups of the source signal lines are charged or discharged completely, and wherein latch pulses for driving the second latch circuits are outputted from the dummy stages of the shift register.

2. A device according to claim 1, wherein the latch pulse is inputted externally.

3. A device according to claim 1, wherein n sampling pulses which are outputted from a dummy stage provided on the first or the last stage of the shift register are utilized as the first to the n-th latch pulses.

4. A driving method of a display device, comprising:

outputting a sampling pulse from a shift register having dummy stages according to a clock signal and a start pulse in sequence;

sampling and holding a video signal according to the sampling pulse in a first latch circuit; and inputting first to n-th (n is an integer of 2 or more) latch pulses to second latch circuits divided into first to n-th (n is an integer of 2 or more) groups so that the first to n-th latch pulses are inputted to the first to n-th groups of the second latch circuits at different timing, respectively;

wherein source signal lines are divided into first to n-th (n is an integer of 2 or more) groups; and the first to n-th groups into which the source signal lines are divided are charged or discharged based on the held video signal according to the first to n-th latch pulses at different timing, respectively, wherein a first n source signal lines each belonging to corresponding one of the first to n-th groups into which the source signal lines are divided are arranged and a second n source signal lines each belonging to corresponding one of the first to n-th groups into which the source signal lines are divided are arranged next to the first n source signal lines, wherein the charge or discharge timing of the first to n-th groups into which the source signal lines are divided is set so that one of the first to n-th groups of the source signal lines is charged or discharged after the others of the first to n-th groups of the source signal lines are charged or discharged completely, and wherein latch pulses for driving the second latch circuits are outputted from the dummy stages of the shift register.

5. A method according to claim 4, wherein the latch pulse is inputted externally.

6. A method according to claim 4, wherein n sampling pulses which are outputted from a dummy stage provided on the first or the last stage of the shift register is utilized as the first to the n-th latch pulses.

* * * * *